US006220789B1

(12) United States Patent
White

(10) Patent No.: US 6,220,789 B1
(45) Date of Patent: Apr. 24, 2001

(54) INTEGRATED EXCAVATION SHORING BUILDING FOUNDATION METHOD

(76) Inventor: Richard W. White, P.O. Box 191313, San Diego, CA (US) 92159

( * ) Notice: Subject to any disclaimer, the term of this patent is extended or adjusted under 35 U.S.C. 154(b) by 0 days.

(21) Appl. No.: 09/223,068

(22) Filed: Dec. 29, 1998

(51) Int. Cl.[7] ..... F02D 27/00

(52) U.S. Cl. ..... 405/229; 405/232; 52/169.9; 52/741.15

(58) Field of Search ..... 405/229, 231, 405/232, 233; 52/169.9, 741.15

(56) References Cited

U.S. PATENT DOCUMENTS

| | | | | |
|---|---|---|---|---|
| 3,184,893 | * | 5/1965 | Booth | 52/741.15 |
| 3,349,527 | * | 10/1967 | Bruns | 52/169.9 |
| 3,457,690 | * | 7/1969 | Clercq | 52/741.15 |
| 3,720,034 | * | 3/1973 | Dawley | 52/169.9 |
| 3,815,369 | | 6/1974 | Meredith . | |
| 3,830,069 | | 8/1974 | Lin . | |
| 4,328,651 | * | 5/1982 | Gutierrez | 52/169.9 |
| 4,421,440 | | 12/1983 | Scheepers . | |
| 4,443,985 | | 4/1984 | Moreno . | |
| 4,528,793 | | 7/1985 | Johnson . | |
| 4,678,373 | | 7/1987 | Langenbach, Jr. . | |
| 4,695,203 | | 9/1987 | Gregory . | |
| 4,911,583 | | 3/1990 | Carey . | |
| 4,913,594 | | 4/1990 | Sigourney . | |
| 5,158,398 | | 10/1992 | Pinho . | |
| 5,302,054 | | 4/1994 | Winkler et al. . | |
| 5,474,399 | * | 12/1995 | Chia-Hsiung | 405/229 |
| 5,580,191 | | 12/1996 | Egan . | |
| 5,944,453 | * | 8/1999 | Gryba | 405/229 |

* cited by examiner

*Primary Examiner*—Eileen D. Lillis
*Assistant Examiner*—Frederick L. Lagman
(74) *Attorney, Agent, or Firm*—Brown Martin Haller & McClain LLP

(57) ABSTRACT

A integrated scheduling method for installing modified precast building columns, first floor grade slab and supporting beams prior to site excavation, and to use these components, together with specialized shoring panels and/or modified exterior wall panels, which are installed simultaneously with the excavation, and together with underground floor structures and beams, as a shoring system during excavation. The shoring or wall panels are forced downwardly to support the excavation sides as excavation proceeds downwards, avoiding the necessity of a conventional shoring system.

13 Claims, 1 Drawing Sheet

INTEGRATED EXCAVATION SHORING BUILDING FOUNDATION METHOD

BACKGROUND OF THE INVENTION

The present invention relates to a novel method for excavation, shoring and construction of buildings with basements.

Excavations for modern buildings are often thirty or more feet deep. In order to excavate safely, systems have evolved to safely support adjacent buildings and streets from cave-ins during the new building construction. Numerous innovative shoring processes, sheet piles, soldier piles, soil nails and tie-backs, are all common methods used to shore construction excavations. All of these methods are installed only for the purpose of supporting the excavation during the construction and not a part of the actual building.

Using any of the current state of the art methods, the shoring is usually installed before the excavation is can be safely accomplished. On a typical large building, the current shoring methods usually take weeks to install. Design plans for the shoring are usually submitted by the specialty shoring contractor and often times official shoring permit approvals require weeks of time. Excavation of a typical large building site can take additional weeks of time, after the shoring is installed. Under present methods, once the excavation is finished, building construction starts from the lowest level basement footing or supporting pile and goes up.

All of the shoring methods and sequences described above are well known to those familiar with large scale construction. Improvements are frequently patented:

U.S. Pat. No. 4,913,594, J. W. Sigourney (Apr. 3, 1990), discloses "a system for connecting facing panels to soldier piles to support the cut fact of an excavation.

U.S. Pat. No. 4,911,583, C. Carey (Mar. 27, 1990), discloses "a method and structure for shoring a vertical face of an excavation . . . using small holes and grouted rods . . . to form vertical columns."

U.S. Pat. No. 4,695,203, S. D. Gregory (Sep. 22, 1987) discloses "An improved method for supporting and shoring building foundations and walls (using) pilings outside the structure."

U.S. Pat. No. 4,678,373, G. F. Langenback (Jul. 7, 1987) discloses a "apparatus for shoring a structure . . . foundation . . . a bracket engageable with the foundation (and) a pile and at least one footing . . . outside the pile."

U.S. Pat. No. 3,815,369, J. A. Meredith (Jun. 11, 1974), discloses "A shoring system for building site excavating operations utilizing caisson holes drilled in spaced positions outside the building perimeter and receiving flanged pile elements . . . "

U.S. Pat. No. 5,580,191, P. D. Egan, discloses "A retaining wall, for marine use . . . of corrugated panels anchored in earth . . . "

It is well known that time is one of the most expensive components of a large building because interest is charged against the funds borrowed by the building owners during the construction process.

SUMMARY OF THE INVENTION

It is a general object of the present invention to save time in the construction process. It is also a general object of the present invention to shave several months off of typical large building construction schedule by building the first floor slab and supporting beams on grade, before any excavation is started, so that the above grade building construction can begin days into the project schedule instead of months. It is also a general object of the present invention to excavate the building site and construct the building foundation by means of an integrated construction/excavation scheduling method which eliminates the need for a conventional shoring system (soldier piles, sheet piles, tie-backs or soil nails) during the excavation/building process.

It is also an object and advantage of the invention to provide a method of installing (below grade) (precast concrete or steel) building columns and piles prior to excavation of the building site by means of drilled holes.

It is also an object and advantage of the invention to provide a method and means of temporarily preventing horizontal movement of said (precast concrete or steel) building columns by use of a concrete back-fill and a schedule for installing said concrete backfill.

It is also an object and advantage of the invention to provide a method and means of preventing said concrete backfill from permanently adhering to said columns.

It is also an object and advantage of the invention to provide a method of shoring the excavation by using the exterior building columns and horizontal (below grade) building floors as support members.

It is also an object and advantage of the invention to provide a method to install the building sidewall panels tight against exterior building columns, and to schedule lowering them simultaneously as the excavation proceeds down, so that, during said installation process, said sidewall panels act as shoring planks.

It is also an object and advantage of the invention to provide and schedule installation of sufficiently rigid shoring panels and planks, supported in the placement process by the exterior building columns, as said shoring panels and planks in turn support the excavation side walls.

It is also an object and advantage of the invention to provide a method of scheduling installation of the below grade beams and slabs "on temporary earth grade" cut as the building excavation progress seriatim down under the (previously cast) ground floor beams and slab, so that said beams and slab provide horizontal support to the building columns which in turn are supporting side wall panels, which are in turn supporting the excavation, this being the object of said invention.

It is also an object and advantage of the invention to provide a method of scheduling excavation for and installation of the below grade building structure under the protection of the first floor building slab, so that construction underground can proceed with extra work shifts and in bad weather, which would normally not be possible with conventional open excavation methods.

It is also an object and advantage of the invention to provide a method of scheduling installation of piles and mass concrete pile caps in such a manner that said installation does not interfere with the scheduling method/process disclosed herein.

SUMMARY OF THE INVENTION

Saving time is a primary object and advantage of the invention. Therefore, the method and scheduling of the installation of standard building components is a primary element of the invention. Employing the construction method herein disclosed, the construction process would proceed as follows.

(1) First construction phase. Beginning at the exterior of the building where the underground parking access is adjacent to the street, holes would be drilled full length and (precast) building columns would be set into said holes and secured with concrete cast in the bottom of said drilled holes. The tops of the columns would be set to grade (typically beneath) the first floor slab.

The columns would be of sufficient length so they would extend beyond the lowest level of the building, so that they, when cast in concrete at their lowest ends, could carry the anticipated loads during the construction process herein described. Once the concrete has set, concrete backfill would then be poured around all sides of the interior columns.

The columns along the exterior of the building would be backfilled with concrete with special care and scheduling. First, the concrete backfill would be installed on the two column sides which are not facing either the interior or the exterior of the building, with care being taken to pour said concrete in even lifts from side to side so as not to exert uneven lateral pressure on said columns. Special care would be taken to prevent concrete from entering the annular space on the exterior side of the column. After this concrete has set, the annular space on the inside face of the column would be filled with concrete. Note that the exterior side of the columns set on the exterior of the building may have a specially hard protective surface layer, (stainless steel, bronze, hard plastic or equal), to facilitate subsequent installation of exterior wall/shoring panels.

(2) Second construction phase, to start one day after start of first phase. Working in shallow trenches, a new crew would begin to Cast In Place (CIP) the concrete beams (or weld in place the steel beams) that tie into the columns installed during the first construction phase. Said beams typically support the first floor slab and secure the tops of the columns one to another, creating a web. Column installation (and concrete backfill) would continue seriatim as in phase #1, above.

(3) Third construction phase, to start one day after first beam pours. A new crew would begin to finish grade (level) the site surface soil in between the concrete (or steel) beams installed the day before. Steel casting pans (or plywood sheets) would be laid on grade, reinforcing steel would be tied place and the first sections of first floor slab would be Cast In Place on grade. Beam installation would continue seriatim as in phase #2, above. Column installation (and concrete backfill) would continue seriatim as in phase #1, above.

(4) Fourth construction phase. A new crew could begin to install 1st floor building columns on the portions of the first floor slab that were poured the day before. All other phases of the construction described above, slab, beams and piles, would continue seriatim.

(5) Fifth construction phase. A new crew could begin to install precast exterior wall panels along the exterior of the perimeter building columns. Said panels (either exterior wall panels or shoring panels) would stand vertically, pressed against the exterior wall columns, supported from below by the soil along the exterior of the building line. Said panels would be held in the vertical position with temporary braces or tied temporarily to 1st floor building columns (above grade). Said panels could be any width from a few feet to several yards. Temporary wooden blocks or clips bolted to the inside face of said exterior wall panels may be used to keep them aligned between adjoining columns during installation process. Said installation process will continue for several days or weeks as the excavation proceeds downward. (See next construction phase, below.)

These exterior wall panels are modified pursuant to the accompanying drawings. Said exterior wall panels would be completely water proofed on their exterior side and said water proofing membrane would be projected with a sufficiently strong (perhaps a steel sheet or equal) surface covering. If, for any reason, it is not practical to install the precast exterior wall panels, precast concrete shoring panels would be installed. All other phases of the construction described above, slab, beams and piles, first floor building columns, would continue seriatim.

(6) Sixth construction phase. A new crew would begin to excavate under the first floor beams and slab at the underground parking access portion of the building near the street. As the excavation proceeds down, the precast wall panels installed in number 5 above, would be forced down, thus acting as shoring for the excavation. The exterior wall panels/shoring panels are supported laterally during this process by the building columns on one face and by the earth on the other face. The panels are forced down simultaneously as the excavation clears the earth from beneath them, so that they are always safely supporting earth loads (pushing inwardly) from the exterior of the building. All other phases of the construction described above, slab, beams and piles, first floor building columns, precast exterior wall panels, would continue seriatim.

(7) Seventh construction phase. As the excavation reaches the level of the first underground parking subfloor grade, a crew would begin to excavate and install the beams that support said floor, whereupon the first underground parking floor slab could be poured in place seriatim. All other phases of the construction described above, slab, beams and piles, first floor building columns, precast exterior wall panels, excavation, would continue seriatim.

(8) All phases of the construction described above, slab, beams and piles, first floor building columns, precast exterior wall panels, excavation, underground beams and slabs, would continue seriatim until the entire underground structure is installed. During this time, construction of the above ground building structure could progress as well.

(9) If precast concrete shoring panels were used instead of exterior wall sections, exterior wall sections could now be cast in place between exterior wall columns.

SUMMARY OF THE INVENTION

The present invention, Integrated Excavation Shoring/Building Foundation Method, consists of integrated schedules and specialized components together with standrad building components, being employed simultaneously and comprising:

(1) specialized construction scheduling method, comprising;
- installation of (below grade) (precast concrete or steel) building columns and piles prior to excavation of the building site by means of drilled holes.
- stabilization of said building columns by use of a concrete backfill;
- building the first floor slab and supporting beams on grade so that the above grade building construction can begin days into the project schedule instead of months;
- install the building sidewall panels and/or precast shoring planks against exterior building columns;
- and to schedule lowering said panels simultaneously as the excavation proceeds down, so that said sidewall panels act as shoring planks;
- installation of the below grade beams and slabs "on temporary earth grade" cut as the building excavation proceeds seriatim down under the (previously cast) ground floor beams and slab, so that said below grade beams and slabs provide horizontal support to the building columns, which in turn are supporting side wall panels, which are in turn supporting the excavation;

excavation for and installation of the below grade building structure under the protection of the first floor building slab.

(2) modified exterior building columns (precast concrete or steel), in the preferred embodiment, comprising;

a method of affixing exterior insulation and water proofing on the exterior surface of the column, prior to installation;

a specially hard, protective, smooth slidable surface layer on the exterior side of the column, (stainless steel, bronze, hard plastic or equal), to facilitate subsequent installation of exterior wall panels/shoring panels; and to protect exterior insulation and water proofing membrane;

notched exterior column corners, when necessary, to accommodate installation of building sidewall panel sections;

a method and means of temporarily preventing horizontal movement of said building columns by use of a concrete (or other sufficiently strong material) backfill;

a method and means of preventing said (concrete in the preferred embodiment) backfill material from permanently adhering to said columns;

a method and means of casting reinforcing steel splices into columns to facilitate later casting to sidewalls, beams and slabs;

(3) modified exterior (basement) building wall panels and/or shoring panels and specialized installation method of said panels so that they are supported laterally in the placement process by the exterior building columns;

so that, during said installation process, said sidewall panels act as shoring planks a method of affixing exterior insulation and water proofing on the exterior surface of the said panels, prior to installation;

a specially hard, (stainless steel, bronze, hard plastic or equal) protective, smooth slidable surface layer on the exterior faces of said panels to protect exterior insulation and water proofing membrane;

a specially hard, (stainless steel, bronze, hard plastic or equal), protective, smooth slidable surface layer on the interior sides and/or edges of the panels at the contact surface where the panels are pressed tightly against building columns;

a method and means of casting reinforcing steel splices into said panels to facilitate later casting to columns, beams and slabs.

BRIEF DESCRIPTION OF THE DRAWINGS

The present invention will be better understood from the following detailed description of an exemplary embodiment of the invention, taken in conjunction with the accompanying drawings, in which like reference numerals refer to like parts, and in which.

DETAILED DESCRIPTION OF THE DRAWINGS

Figure 1:
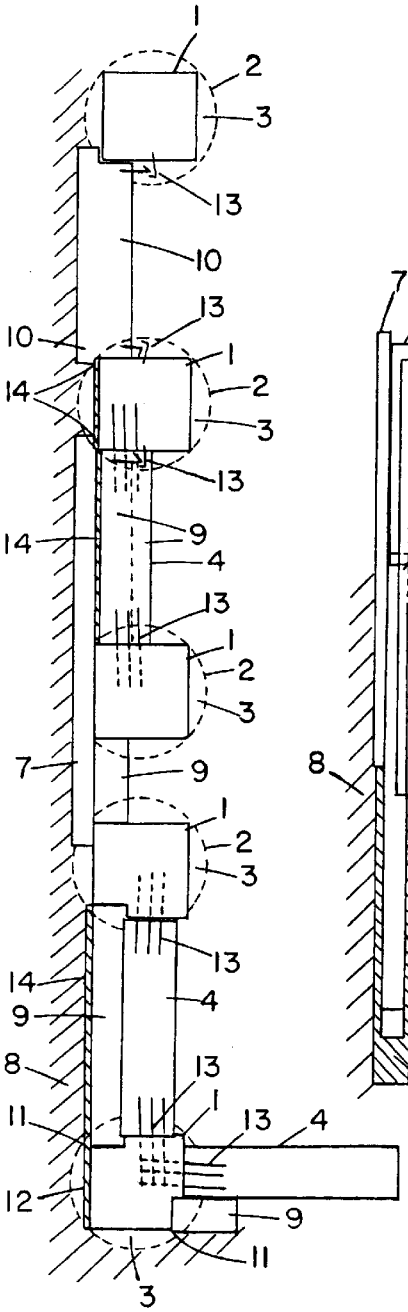
FIG. 1 is a plan view illustrating part of a building foundation/excavation shoring system and method according to an exemplary embodiment of the invention.
Figure 2:
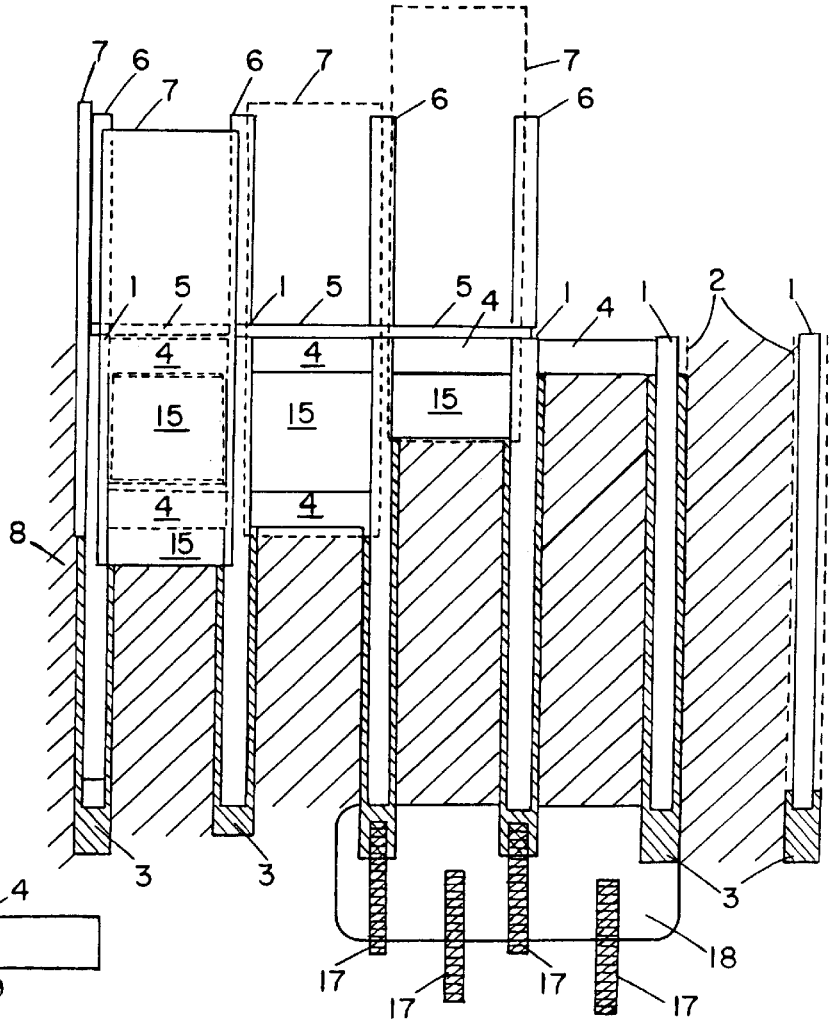
FIG. 2 is a side elevation view of the shoring system of FIG. 1 illustrating the start of an excavation.

FIG. 1 shows a plan view of precast columns 1; set to grade in drilled holes 2; columns 1 are stabilized on the elevation grade and held in place with concrete 3 poured in the annular space between hole 2 and column 1; cast in place concrete beam 4 (or steel beam) is shown cast (or welded) between columns 1; precast concrete (or other suitably strong material, such as steel sheets) shoring plank 7; Shoring planks 7 may sheet multiple column sections as shown; undisturbed earth 8; cast in place building exterior wall 9; modified combination exterior building wall/shoring panel 10 is shown for use with columns 1; a specially hard, protective surface 14 shown on the exterior side of the columns 1 and exterior wall panels 9; columns 1 may be cast with notches 11 to receive exterior building wall sections 9; exterior building wall sections may be cast in place when shoring panels 7 are used; exterior insulation and water proofing 12 is shown on the exterior surface of the column 1, placed prior to column installation; reinforcement steel for tying columns to slabs, beams and building walls 13; a specially hard, protective, smooth surface layer 14 on the exterior side of wall panels 9, said surface layer made of (stainless steel, bronze, hard plastic or equal), to protect exterior insulation and water proofing membrane (12) which is placed on exterior wall sections 9, prior to their installation;

FIG. 2 shows an elevation view of existing earth 8; columns 1 placed in drilled holes 2 secured in place with sufficient concrete 3 under the bottom of the columns 1 to carry anticipated loads; and subsequently placed concrete 3 poured into the annular space around the columns 1; note that no concrete 3 is poured on the exterior face of building perimeter columns 1 above the level of basement subfloor (not shown); floor slab concrete beams 4 are shown cast on grade into earth 8; floor slabs 5 are also cast onto grade; first level basement slab 5 is shown below ground floor level slab 5; first floor building columns 6 are shown on slab 5; shoring panels 7 are shown at various elevations as they are forced down in conjunction with excavation 15; temporarily shoring panel bracing is not shown; shoring panels are supported vertically by earth 8 as they are forced down along side columns 1; as excavation 15 opens access beneath shoring panels 7 they are forced down to basement sub-grade; Shoring planks 7, 10 and wall sections 14, would be full length for the depth of basement excavation in the preferred embodiment; however, shoring planks 7, 10 and wall sections 14 could be half lengths, or shorter and set vertically on top of previously installed planks seriatim; piles 17 are shown beneath columns 1; piles 17 are placed in drilled holes 2 and cast in place, or when conditions warrant, set into drilled holes 2, prior to other work, and drove to design elevation; mass concrete pile cap 18 is shown; it is installed after all other work is done, but prior installation of lowest level basement slabs and footings if they interfere with pile cap installation. Excavation 15 begins from the exterior of the building perimeter under 1st floor slab 5 and beams 4 at basement parking lot entrances (not shown) or at other convenient location, and thereafter progresses from inside the build perimeter, and underneath already constructed beam and slab elements.

Reference Numerals In the Drawings

Number 1 is precast building columns;

Number 2 is drilled holes;

Number 3 is concrete;

Number 4 is building support beams;

Number 5 is building slab floor;

Number 6 is building column above grade;

Number 7 is shoring panel; precast concrete or steel plate, etc.

Number 8 is undisturbed earth;

Number 9 is precast building wall section;

Number 10 is precast shoring plank/building wall section;

Number 11 is notched column surface to receive wall section;

Number 12 is water proof membrane;

Number 13 is exposed reinforcement steel splices;

Number 14 is a specially hard, protective, smooth surface layer;

Number 15 is excavated area under beams and slabs;

Number 17 is piles;

Number 18 is mass concrete pile cap;

OPERATION OF THE INVENTION

The work is scheduled so that piles 17, (if any), are set into drilled holes 2; and cast in place with concrete 3; or alternately, piles 17 are set into holes 2 drilled to a depth of the building basement bottom and drove to design grade. Building columns 1 are set into drilled holes 2 and cast in place with sufficient concrete 3 to support loads anticipated by this construction method. The upper portions of the precast columns 1 are treated so that backfill concrete 3 does not adhere to said columns except at the bottom. The annular space around columns is then filled on each side with concrete 3, except that no concrete is poured on the exterior side of the columns above the basement floor sub-grade; and, concrete 3 is not poured on the inside face until the concrete 3 on the sides has set.

As soon as some columns 1 have been placed, a new crew may begin to dig trenches for first floor beams 4 which are cast in place on grade (in the case of concrete) (or steel beams are affixed to the columns per plan design on grade), thus tying the column 1 tops together in a web of cross-sectional beams 4. As more columns are placed and more beams are poured in place, the tops of all columns are soon secured to the tops of all others is a single unit.

As soon as some of the beams have been cast or set, the soil between the beams may be leveled to floor sub-grade. A new crew would then begin to finish grade (level) the soil in between the beams 4. Steel casting pans (or plywood sheets) would be laid on grade, reinforcing steel would be tied in place and the first sections of the first floor slab 5 would be cast in place on grade. Beam 4 installation would continue seriatim as above and column 1 installation (and concrete 3 backfill) would continue seriatim as above until all are installed.

As soon as some of the first floor slab 5 has been cast and sufficiently cured, workers could begin to install 1st floor building columns 6 on said slab. All other phases of the construction described above, slab, beams and piles, would continue seriatim.

Excavation 15 begins under 1st floor slab 5 and beams 4 at basement entrances (not shown) or at other convenient location, as soon as the beams 4 have cured sufficiently. Shoring planks 7, 10 or wall sections 11 are set into position behind columns and lowered as excavation from under the first floor building slab admits access for said panels. No excavation is done from the outside of the building structure. Temporary braces or building frame members may hold/align shoring planks (vertical) during installation. All other work described above continues seriatim.

As excavation admits access, (highest level) basement slabs and beams are cast in place on grade. This process continues until the entire underground structure is in place. The finished basement may be pressurized with air to force out groundwater once the first floor grade slab is finished by using pressure sealed access.

Shoring plank 7 widths would normally be determined by distance between building columns per design, i.e., 10 feet to 20 feet, but they could be much wider.

Where reinforcing steel 13 occurs in columns 1 or building exterior wall panel 10 section/shoring planks 7 & 10, (such as at floor/footing and beam intersections), reinforcing steel will be CIP in column and/or shoring plank/exterior wall sections and bent aside for later use.

Where mass concrete (pile-cap) occurs over clustered piles, it may be poured after building excavation is complete.

What is claimed is:

1. A method of integrated construction of a building excavation shoring and building foundation, comprising the steps of:

drilling a plurality of holes at spaced intervals across an area in which a building having an underground level is to be constructed, the holes being drilled at least to the depth of one underground floor level;

setting building columns into said holes, the columns having upper ends at a level corresponding to the undersurface of a first floor slab of the building;

stabilizing the columns with supporting material;

securing the upper ends of the columns together with horizontal building beams to form a web;

casting the first floor slab above the columns and horizontal building beams;

installing exterior panels around the exterior of the building first floor area and supporting the panels vertically to define exterior walls; and excavating the area under the exterior panels, first floor horizontal beams and slab, as excavation proceeds, lowering the exterior walls, as excavation proceeds to surround the underground area, acting as a shoring for the excavation.

2. The method as claimed in claim 1, including the steps of, after pouring the first floor slab, installing first floor building columns around at least the periphery of the first floor, and using the first floor building columns as a temporary vertical support for said exterior panels.

3. The method as claimed in claim 1, including the steps of continuing the excavation down to a desired subfloor grade level, installing horizontal beams at said subfloor level to support a subfloor, and pouring a first underground floor slab on top of said beams.

4. The method as claimed in claim 1, including the step of using the exterior panels as building side walls for the subfloor level when excavation is complete.

5. The method as claimed in claim 1, wherein the step of lowering the exterior walls includes receiving opposite side edges of at least some of the exterior panels in vertically extending notches in adjacent building columns at the periphery of the area to be excavated, the notches having open upper ends for receiving the panel side edges.

6. The method as claimed in claim 1, wherein the holes are drilled to the depth of a plurality of basement subfloor levels, building columns are set into each hole to extend from the bottom of the hole to the level of the first floor slab, and the exterior panels each have a height equal to the total depth of the basement subfloor levels whereby are progressively lowered to the full depth of the subfloor levels as excavation proceeds.

7. A building excavation and construction assembly, comprising:

a plurality of pre-made building columns for insertion in holes in a building site drilled to the total depth of the subfloor levels of a building to be constructed, each column having a height substantially equal to the total subfloor depth;

a plurality of building beams for securing the upper ends of the building columns together to form a web at the level of a first floor slab of the building;

a plurality of exterior panels for providing shoring as the subfloor levels are excavated beneath a first floor slab; and support and guide assemblies for supporting the exterior panels vertically around a periphery of the building above ground level at the start of excavation, and guiding the exterior panels downwardly as excavation proceeds beneath them until they surround the periphery of the subfloor level.

8. The assembly as claimed in claim 7, wherein the exterior panels have opposite side edges, and selected peripheral building columns for installation around the periphery of the subfloor levels have vertically extending notches for guiding the side edges of the panels as they are lowered during excavation to surround the subfloor level, the notches having open upper ends.

9. The assembly as claimed in claim 8, wherein each of the peripheral building columns have outer faces having a protective surface layer of harder material.

10. The assembly as claimed in claim 9, wherein the surface layer is metal.

11. The assembly as claimed in claim 9, wherein the surface layer is hard plastic.

12. The assembly as claimed in claim 7, wherein each exterior panel has an outer surface having an outer protective layer of harder material.

13. The assembly as claimed in claim 12, wherein the outer surface of each exterior panel has a water proof membrane between said outer surface and outer protective layer.

* * * * *